United States Patent [19]

Shapiro

[11] Patent Number: 4,671,482

[45] Date of Patent: Jun. 9, 1987

[54] TRIP MAP AND TOLL TICKET HOLDER

[76] Inventor: Allan E. Shapiro, 113 Misty Woods Dr., Grovetown, Ga. 30813

[21] Appl. No.: 903,171

[22] Filed: Sep. 3, 1986

[51] Int. Cl.[4] ..... A47F 5/08

[52] U.S. Cl. ..... 248/225.2; 248/205.3; 248/339; 248/309.1

[58] Field of Search ..... 248/225.2, 205.3, 225.1, 248/233.4, 231.7, 231.8, 304–307, 309.1, 316.7, 339, 340, 317, 322; 40/10 R, 11 R

[56] References Cited

U.S. PATENT DOCUMENTS

| | | | |
|---|---|---|---|
| 774,036 | 11/1904 | Burgess | 248/316.7 |
| 1,534,151 | 4/1925 | Bahsler . | |
| 1,632,856 | 6/1927 | Running . | |
| 1,681,586 | 8/1928 | Kessler | 248/309.1 |
| 2,563,580 | 8/1951 | Clark . | |
| 2,787,070 | 4/1957 | Idoine . | |
| 2,824,393 | 2/1958 | Shapiro . | |
| 3,300,164 | 1/1967 | Welles | 248/205.3 |
| 4,040,522 | 8/1977 | Vickery | 248/205.3 |
| 4,283,869 | 8/1981 | Rappa . | |
| 4,299,342 | 11/1981 | Kessler | 248/340 |
| 4,557,063 | 12/1985 | Bloom | 40/10 R |
| 4,625,441 | 12/1986 | Fast | 40/10 R |

FOREIGN PATENT DOCUMENTS

| | | | |
|---|---|---|---|
| 660308 | 11/1951 | United Kingdom | 248/205.3 |

*Primary Examiner*—Reinaldo P. Machado
*Assistant Examiner*—Alvin Chin-Shue
*Attorney, Agent, or Firm*—Henderson & Sturm

[57] ABSTRACT

A trip map and toll ticket holder apparatus (10) including a retention unit (12) comprising a bracket member (25) having a hook member (26) provided with a narrow slit (29) which frictionally engages a toll ticket (50); and, a suspension unit (11) comprising an open V-shaped suspension member (13) having an upper arm (14) adapted to releasably engage the hook member (26) and a lower arm (17) dimensioned to engage the loops of a spiral binding (102) which secure map segments (101) together.

6 Claims, 5 Drawing Figures

FIG. 1.
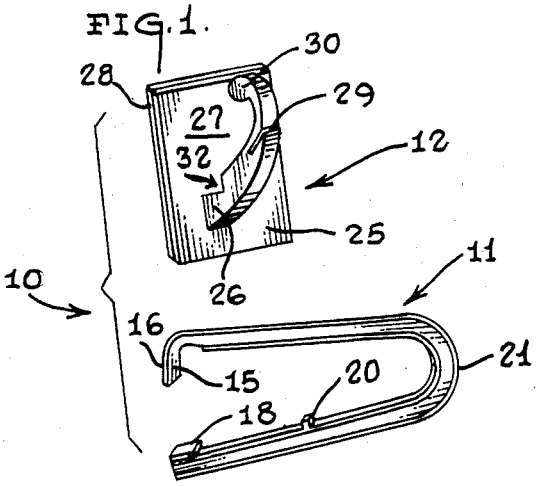
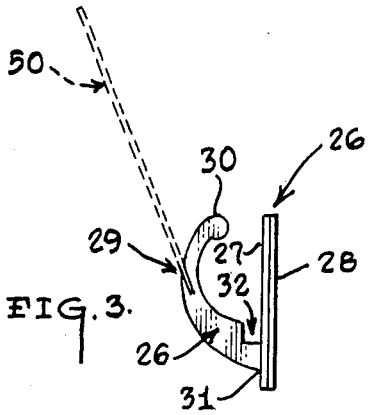
FIG. 3.
FIG. 4.
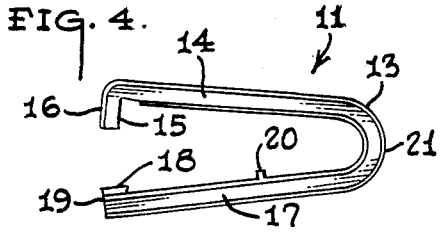
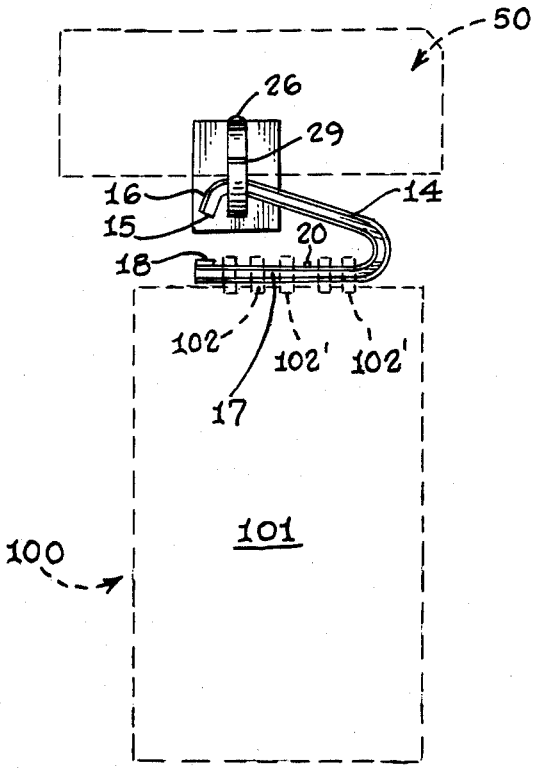
FIG. 2.
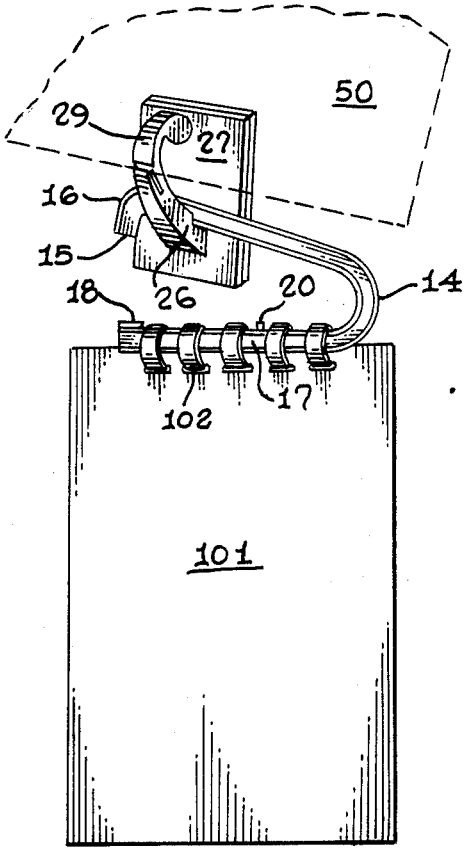
FIG. 5.

TRIP MAP AND TOLL TICKET HOLDER

TECHNICAL FIELD

The present invention relates generally to suspension and support apparatus for flexible sheet material.

BACKGROUND OF THE INVENTION

This invention was the subject matter of Disclosure Document No. 147119 filed in the U.S. Patent and Trademark Office on Feb. 20, 1986.

While the prior art is replete with diverse specialized support apparatus for maps and other flexible sheet material as can be seen by reference to the following U.S. Pat. Nos.: 1,534,151; 1,632,856; 2,563,580; 2,787,070; 2,563,580; 2,824,393; and, 4,283,869, none of these prior art constructions have proven to be entirely satisfactory from the end users standpoint.

While it will be conceded that these prior art constructions are merely adequate for their intended purpose and function, it must also be emphasized that these previously patented structures contain unique and shared deficiencies and disadvantages in both their design, function, and operation.

The most common deficiency found among the prior art constructions involves the large number of structural components involved in the manufacture of those prior art devices. The tendency towards over-engineering, increases not only the cost to the consumer, but also increases the probability that at least one of the multiple components will experience structural failure rendering the apparatus inoperable.

Another drawback of the aforementioned complex constructions is that these devices invariably involve extensive modifications to a vehicle interior, either to mount the device on an interior surface, or in some instances merely to provide room to even accommodate the logical and desirable deployment of the apparatus within a vehicle.

Another unfavorable characteristic of the prior art constructions is the tendency of some of the devices to require a specialized map component, that can only be used in conjunction with a particular map holder, and which is incompatible with most commonly available map formats.

In todays society, anyone who encounters toll roads enroute to an unfamiliar destination will quickly experience the frustration, inconvenience, and anxiety produced by the necessity of having to constantly refer to a map to insure that they are proceeding towards their intended destination; coupled with the added aggravation of finding a secure, convenient, and loss proof location for their toll card.

Obviously there exists a pressing need for a combined holder for toll tickets and commonly available map constructions; wherein, the apparatus will be compact, easily installed, simple in construction and operation, convenient and inexpensive.

BRIEF SUMMARY OF THE INVENTION

Recognizing the inherent drawbacks and deficiencies in the prior art constructions, an entirely new approach was taken in the development of the apparatus that forms the subject matter of this invention.

Considering the problems associated with the prior art devices and the ultimate objectives desired in the finished product, it was soon recognized that a universal map holder was beyond the scope of the present invention.

Given that realization and acceptance of the practicalities involved, an attempt was undertaken to develop a map holder that would be compatible with map constructions that are commonly available from most major automobile clubs and travel agencies.

It was further realized that; in as much as, the map normally would be handled on a much more frequent basis than the toll ticket; that the apparatus would require two distinct but cooperating components.

As a consequence of the foregoing situation, the present invention comprises a ticket retention unit and a map suspension unit; wherein, the ticket retention unit is secured to an interior surface of a vehicle, and the map suspension unit is designed to releasably engage the ticket retention unit to facilitate the access of the map contents to the operator of the vehicle.

Once the initial operating parameters were defined and addressed, an attempt was undertaken to refine the invention in accordance with the following criteria: compactness, ease of installation and use; reliability, durability, and low cost.

The trip and toll ticket apparatus that will be described in detail later on in this specification represents the successful culminiation and attainment of all of the objectives stated above.

BRIEF DESCRIPTION OF THE DRAWINGS

These and other objects, advantages, and novel features of the invention will be come apparent from the detailed description of the best mode for carrying out the preferred embodiment which follows; particularly when considered in conjunction with the accompanying drawings; wherein:

FIG. 1 is an exploded perspective view of the two major components of this invention.

FIG. 2 is a perspective view of the apparatus in its operative mode.

FIG. 3 is a side elevation view of the toll ticket retention unit.

FIG. 4 is a side elevation view of the map suspension unit; and,

FIG. 5 is a perspective view of the apparatus disposed in its intended environment.

BEST MODE FOR CARRYING OUT THE INVENTION

As can be seen by reference to the drawings and in particular to FIG. 1, the trip map and toll ticket holder apparatus that forms the basis of the present invention is designated generally by the reference numeral (10). The trip map and toll ticket holder apparatus (10) comprises a map suspension unit (11), and a toll ticket retention unit (12). These units will now be described in seriatim fashion.

As can best be seen by reference to FIGS. 1 and 4, the trip map suspension unit (11) comprises an elongated relatively narrow open ended suspension member (13) having a generally V-shaped configuration; wherein, the upper arm (14) of the suspension member (13) is provided with a downwardly projecting hook portion (15) formed on its outboard end (16). The lower arm (17) of the suspension member (13) is provided with a raised lip element (18) formed on its outboard end (19); and, a raised tang element (20) disposed proximate to, but spaced from the juncture (21) of the upper (14) and lower (17) arms of the suspension member (13).

As shown in FIGS. 1 and 3, the toll ticket retention unit (12) comprises a mounting bracket member (25) having a generally C-shaped hook member (26) formed integrally therewith. The bracket member (25) comprises a generally rectangular bracket element (27) having an adhesive backing (28) formed on the rear surface; with the hook member (26) projecting outwardly and upwardly from the lower portion of the face of the bracket element (27).

As can best be seen in FIG. 3, the hook member (26) is provided with a narrow slit (29) formed on its outboard surface intermediate the free end (30) and the captive end (31) of the hook member (26). In addition, the inboard surface of the hook member (26) is provided with a recess (32) formed adjacent the juncture of the hook member (26) with the bracket member (25).

As mentioned earlier in the specification, the toll ticket retention unit (12) was developed specifically to support and retain a toll ticket (50). As shown in phantom in FIGS. 2 and 3, the narrow slot (29) formed on the hook formed on the hook member (26) is dimensioned to frictionally engage and retain a toll ticket (50) by the selective positioning of the adhesive backing (28) on the interior surface of a vehicle (not shown).

As was also mentioned earlier in the specification, the trip map suspension unit (11) was specifically developed to suspend a common form of map construction (100) employed by numerous automobile clubs and travel agencies. The specific map construction (100) envisioned for use with the preferred embodiment of this invention comprises a plurality of map segments (101) operatively secured together by a spiral binding (102), similar to the TRIPTIK TM maps offered by the American Automobile Association.

As can be seen by reference to FIGS. 2 and 5, the lower arm (17) of the map suspension unit (11) is dimensioned to be received by the loops (102') of the spiral binding (102); wherein, the raised lip element (18) and the raised tang element (20) of the lower arm (17) function as keeper means to restrain the lateral displacement of the spiral binding (102) on the lower arm (17), in a well recognized manner.

As can also be seen in FIGS. 2 and 5, the hook portion (15) on the outboard end (16) of the upper arm (14) of the suspension unit (11) is provided to limit the lateral displacement of the upper arm (14) of the suspension unit (11) within the recess (32) of the toll ticket retention unit (12), much in the manner of a skyhook or the like.

At this point, it should be appreciated that the map suspension unit (11) is dimensioned to releasably engage and disengage the toll ticket rentention unit (12) in either the vertical or horizontal direction to facilitate the accessibility of the map segments (101) to the user.

Having thereby described the subject matter of this invention, it should be apparent that many substitutions, modifications and variations of the invention are possible in light of the above teachings. It is thereby to be understood that the invention as taught and described herein is only to be limited to the extent of the breadth and scope of the appended claims.

I claim:

1. A trip map and toll ticket holder apparatus for use with toll tickets and a map construction involving a plurality of map segments secured by a spiral binding; wherein, said apparatus comprises:

a toll ticket retention unit comprising a bracket member having a generally C-shaped hook member extending outwardly and upwardly from the lower portion of the bracket member; wherein, the outboard surface of the hook member is provided with a narrow slit that is dimensioned to frictionally engage a toll ticket; and, a trip map c-shaped suspension unit comprising an elongated open ended suspension member having an upper arm dimensioned to be releasably received by the hook member of said toll ticket retention unit; and, having a lower arm which is dimensioned to engage a portion of said map construction.

2. The apparatus of claim 1; wherein, said toll ticket retention unit further comprises:

an adhesive backing provided on the rear surface of said said bracket member; and, a recess formed on the inboard surface of said hook; member adjacent the juncture of the hook member with the bracket member; wherein, said recess is dimensioned to releasably receive the upper arm of said suspension member.

3. The apparatus of claim 2; wherein, said trip map suspension unit further comprises:

a downwardly projecting hook portion formed at the open end of said upper arm; wherein, said hook portion limits the lateral movement of the suspension unit relative to the retention unit.

4. The apparatus of claim 3; wherein, said trip map suspension unit also comprises:

a raised lip element formed at the open end of said lower arm and a raised tang element disposed proximate to, but spaced from, the juncture of the upper and lower arms of said suspension member.

5. The apparatus of claim 4; wherein, said lower arm of said suspension member is dimensioned to be received within the loops formed by the spiral binding of said map construction.

6. The apparatus of claim 5; wherein, said raised lip element and said raised tang element cooperate to limit the lateral translation of the spiral binding on said lower arm of said suspension member.

* * * * *